United States Patent [19]

Leblanc

[11] Patent Number: 4,574,759

[45] Date of Patent: Mar. 11, 1986

[54] FUEL INJECTION PUMP

[75] Inventor: Jean Leblanc, Lyons, France

[73] Assignee: Robert Bosch GmbH, Stuttgart, Fed. Rep. of Germany

[21] Appl. No.: 670,140

[22] Filed: Nov. 13, 1984

Related U.S. Application Data

[62] Division of Ser. No. 385,950, Jun. 7, 1982, abandoned.

[30] Foreign Application Priority Data

Jun. 23, 1981 [DE] Fed. Rep. of Germany ..... 3124500

[51] Int. Cl.[4] ..... F02M 39/00

[52] U.S. Cl. ..... 123/450; 123/387

[58] Field of Search ..... 123/450, 387, 458, 459, 123/446–447, 457

[56] References Cited

U.S. PATENT DOCUMENTS

| | | | |
|---|---|---|---|
| 3,358,662 | 12/1967 | Kulke | 123/459 |
| 4,387,686 | 6/1983 | Leblanc | 123/459 |
| 4,393,826 | 7/1983 | Tumber | 123/446 |
| 4,398,518 | 8/1983 | Leblanc | 123/446 |

FOREIGN PATENT DOCUMENTS

| | | | |
|---|---|---|---|
| 1305930 | 2/1973 | United Kingdom | 123/458 |
| 2061403 | 5/1981 | United Kingdom | 123/450 |
| 2076075 | 11/1981 | United Kingdom | 123/450 |

*Primary Examiner*—Carl Stuart Miller

*Attorney, Agent, or Firm*—Edwin E. Greigg

[57] ABSTRACT

A fuel injection pump in which for the purpose of controlling the injection quantity and in particular to determine the onset and end of injection, a hydraulically actuatable piston slide is provided, which controls a connection between the pump work chamber and a fuel supply line or the fuel supply container. The control is effected via two magnetic valves acting in opposite directions, by means of which two different, high control pressures acting upon the piston slide can be exerted. The control pressures are made available either with a single pressure control valve and by blocking off the relief of the supply side of the fuel supply pump, or else by means of two pressure control valves.

6 Claims, 6 Drawing Figures

FUEL INJECTION PUMP

This is a division of copending application Ser. No. 385,950 filed June 7, 1982, now abandoned.

BACKGROUND OF THE INVENTION

The invention relates to a fuel injection pump having a pump work chamber enclosed by a pump piston in a cylinder, having a fuel distributing arrangement for connecting the pump work chamber with one or more fuel injection locations, and having a fuel supply arrangement for connecting the pump work chamber with a fuel supply to establish the fuel injection quantity. The fuel supply arrangement includes a fuel supply line of the pump work chamber, a fuel supply pump for supplying fuel to the fuel supply line, a pressure control device for adjusting the supply pressure of the fuel supply pump, a valve disposed in the fuel supply line, and an electric control device for controlling the actuation of the valve.

In an injection pump of this kind, such as that known from German Offenlegungsschrift 19 17 927, the fuel quantity to be injected during the supply stroke of the pump piston of the injection pump is determined by a first magnetic valve, which controls the onset of injection, and by a second magnetic valve, controlling the end of injection. At the onset of injection, the first magnetic valve closes the connection between the pump work chamber and the suction chamber of the injection pump, while the second magnetic valve is closed during this time. At the end of injection, the second magnetic valve then opens and relieves the pump work chamber toward the pump suction chamber. For this kind of control of a fuel injection pump, very rapidly switching magnetic valves which are also very forceful are required; furthermore, in order to avoid having dead spaces, such valves must be disposed with the closing member in the immediate vicinity of the mouth of the fuel supply line in the pump work chamber. The magnetic valves used in the known fuel injection pump have closing members which are directly exposed in their direction of movement to the working pressure in the pump work chambers. In order to keep these closing members in the closing position, great magnetic forces, reinforced by spring forces, are required. Accordingly, the magnets are very large and are difficult to accommodate in the injection pump itself.

OBJECT AND SUMMARY OF THE INVENTION

The invention constitutes a fuel injection pump of the known type described above, in which the valve disposed in the fuel supply line comprises a piston slide stressed by a restoring spring. The piston slide includes a control edge for controlling the passage of the fuel supply line and a first end face defining a first pressure chamber which is continuously exposed to the supply pressure of the fuel supply pump. The electric control device for controlling the actuation of the valve includes first and second electrically actuatable valves disposed in parallel lines for connecting the fuel supply line with the supply side of the fuel supply pump. The pressure control device includes a pressure control valve for relieving pressure in the fuel supply line downstream of the two electrically actuated valves.

The fuel injection pump according to the invention has the advantage over the prior art that only a small-sized hydraulic switching valve has to be accommodated in the injection pump itself in the immediate vicinity of the pump piston, and the control pressures of this valve are established by means of two electrically actuatable valves which in particular are not exposed to the working pressure in the pump work chamber. With these two electrically actuatable valves, together with an appropriately embodied control unit, the injection timing and metering of the fuel quantity can be controlled precisely. It is also possible to shut off the fuel pump or interrupt the fuel supply by electrical means. It is a further advantage that the two electrically actuatable valves are built using fewer materials and for this reason can be integrated with the pump apparatus.

The invention will be better understood and further objects and advantages thereof will become more apparent from the ensuing detailed description of three preferred embodiments taken in conjunction with the drawings.

BRIEF DECRIPTION OF THE DRAWINGS

Figure 1:
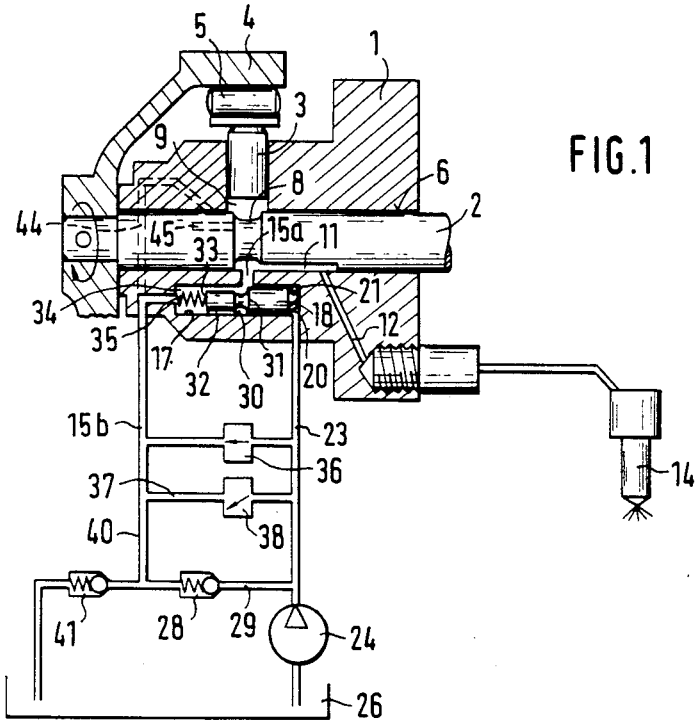
FIG. 1 shows a first exemplary embodiment of the invention, in the form of a radial piston pump having a revolving cam ring and a rotating central distributor, parallel to which the valve is disposed.
Figure 6:
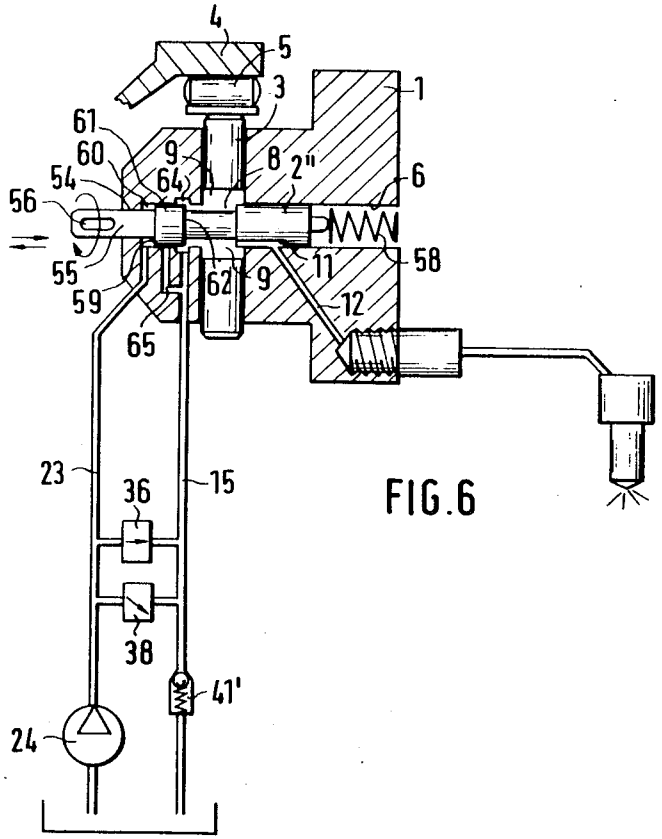
Figure 5:
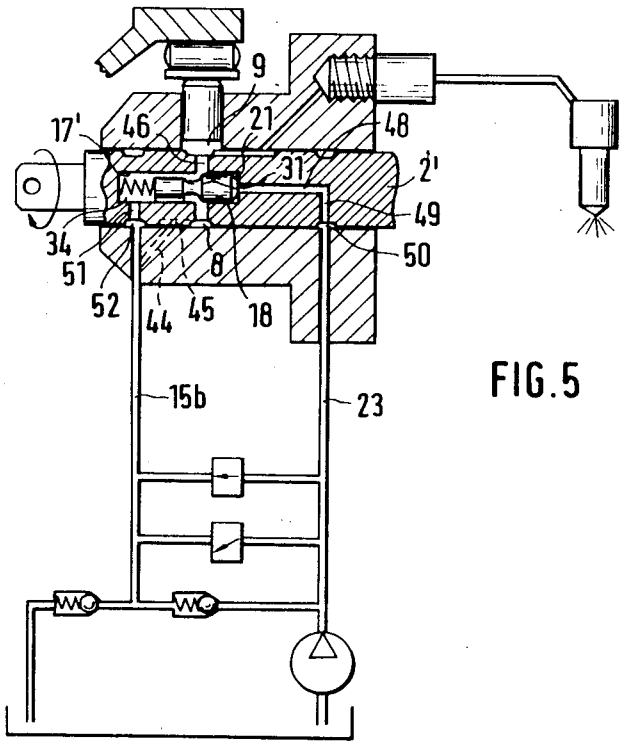

FIG. 5 shows a second exemplary embodiment of the invention, in a fuel injection pump of the same type as that shown for the exemplary embodiment of FIG. 1, but having a valve which is disposed in the interior of the distributor; and FIG. 6 shows a third exemplary embodiment of the invention, in which the distributor in a radial piston pump is disposed such that it is displaceable and is simultaneously embodied as the piston slide of a valve controlling the fuel injection quantity.

DESCRIPTION OF THE PREFERRED EMBODIMENTS

Both a distributor 2 and radially disposed pump pistons 3 are supported in the housing 1 of a fuel injection pump. The pump pistons 3 are driven via a cam ring 4, which in cup-like fashion surrounds the portion of the housing 1 carrying the pump pistons 3 and is connected with the drive shaft (not shown) of the fuel injection pump. Rollers 5 for actuating the pump piston 3 are disposed between the cam ring 4 and the pump piston 3, sliding by way of the cams of the cam ring 4. The distributor 2 is coupled with the drive shaft by a coupling which is not shown, the distributor 2 being axially displaceable within a distributor cylinder 6 which receives the distributor 2 and is disposed in the housing 1. An annular groove 8 is disposed on the jacket face of the distributor and adjacent to the pump work chambers 9. Branching off from the annular groove 8 is a longitudinal groove 11, which as the distributor groove cooperates with injection lines 12, which lead from the cylinder 6 to the fuel injection nozzles 14 on the engine and are opened one after another by means of the longitudinal groove 11.

Discharging into the annular groove 8 or the pump work chambers is a very short part 15*a* of a fuel supply line 15, which connects the distributor cylinder 6 with a second cylinder 17 located parallel to the cylinder 6. A piston slide 18 is disposed in the cylinder 17 and with its first end face 20 it encloses a first pressure chamber 21, which communicates via a pressure line 23 with the supply side of a fuel supply pump 24. This pump 24 supplies fuel under pressure from a fuel supply container 26 to the pressure line 23 and is suitable for establishing a pressure there of 30 bar, for example. The pressure on the supply side is adjustable to this end with the aid of a first pressure control valve 28, which is located in a relief line 29 branching off from the pressure line 23.

The piston slide 18 further has an annular groove 30, one limiting edge 31 of which controls the entry of the fuel supply line part 15*a* into the cylinder 17. The annular groove 30 further communicates via longitudinal grooves 32 with a second pressure chamber 34, which is enclosed in the cylinder 17 by the other end face 33 of the piston slide 18. A restoring spring 35 is disposed there as well, acting upon the piston slide 18. The other fuel supply line part 15*b* discharges into the second pressure chamber 34 in a manner such that it cannot be closed off; this part 15*b* can be made to communicate with the pressure line 23 by means of a first electrically actuatable valve, by way of example a magnetic valve 36. A parallel connection exists between the pressure line 23 and the fuel supply line part 15*b* via a parallel line 37, which includes a second electrically actuatable valve 38. A relief line 40 further branches off from the fuel supply line 15*b*, and a second pressure control valve 41 is disposed in this relief line 40. The portion of the first relief line 29 located downstream of the first pressure control valve 28 can thus discharge into the second relief line 40 upstream of the second pressure control valve 41.

Figure 2:
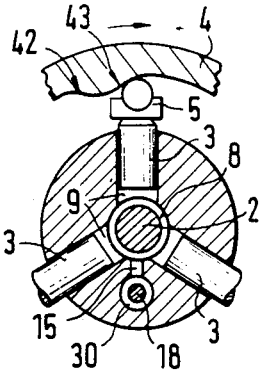
FIG. 2 is a first section taken through the fuel injection pump of FIG. 1.

With the aid of the section through the fuel pump shown in FIG. 2, in the plane of movement of the pump pistons, the mode of operation of the above-described fuel injection pump can now be explained. When the fuel injection pump is in operation, the cam ring 4 executes a rotating movement, so that the rollers 5, following the cam curve, cause the pump pistons 3 to execute a reciprocating axial movement. The inward movement is effected under the influence of the upwardly inclined edge of the cam, while the outward movement of the pump pistons is effected by means of the charge pressure of the fuel flowing into the work chambers 9. Once the roller 5, after an injection stroke, is located on the trailing edge 42 of the cam on the cam ring, the first magnetic valve 36 is opened. A fuel pressure limited by the pressure control valve 41 is then established in the fuel supply line 15*b*. The fuel flows into the second pressure chamber 34. The first pressure chamber 21 is also under the same low presure once the first electrically actuatable valve 36 opens. The piston slide, now balanced in pressure, is displaced toward the right by the spring 35, so that the control edge 31 opens the entry of the fuel supply line 15*a* into the cylinder 17 or into the annular groove 30. Fuel is now capable of flowing freely into the work chambers 9, which all communicate with one another via the annular groove 8.

As soon as the rollers 5 arrive at a leading edge 43 of a cam, the pump pistons 3 again execute an inward movement and positively displace a portion of the fuel introduced into the pump work chambers 9 back by way of the fuel supply line 15. This quantity can escape via the pressure control valve 41.

Figure 3:
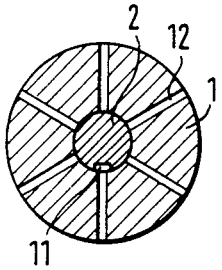
FIG. 3 is a second section taken through the fuel injection pump of FIG. 1.

With the desired injection onset, the electrically actuated valve 36 is now closed; simultaneously, the second electrically actuated valve 38 is closed as well. The result of this is that the pressure in the pressure line 23 increases and is limited by the pressure control valve 28 to the value set there. The increase of pressure in turn causes the piston slide 18 to be displaced toward the left, counter to the force of the spring, because of the increasing pressure in the first pressure chamber 21. The result is that the opening of the fuel supply line 15*a* is also closed by the control edge 31. The fuel now further positively displaced by the pump pistons 3 is delivered via the longitudinal groove 11, which leads away from the annular groove, into one of the injection lines 12, which at this instant corresponds with the longitudinal groove 11. This position is shown in cross section in FIG. 3. The end of injection is attained in that the second electrically actuatable valve 38 is opened and the pressure line 23 is thus relieved to the pressure level established by the second pressure control valve 41. The slide 18, now balanced in pressure, is returned by the restoring spring 35 and the fuel supply line 15*a* is opened once again. The remaining quantity of positively-displaced fuel can now escape into the fuel supply line 15*b* or via the second pressure control valve 41. As soon as the rollers 5 reach the high point of the cam, both valves 35 and 38 are switched over once again, so that they assume their outset position. The two electrically actuatable valves are switched in opposite directions to one another here and for the purpose of limiting the duration of injection they enable substantially shorter switching times, which are still effective for regulation, than those resulting in the case of a conventional, pressure-balanced magnetic valve switched individually.

Figure 4:
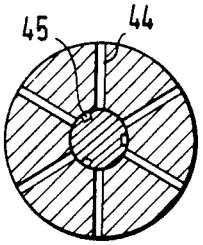
FIG. 4 is a third section taken through the fuel injection pump of FIG. 1.

The supply of fuel to the work chambers 9 may in some cases be improved by providing that an additional line 44 from the fuel supply line 15*b* discharges into the cylinder 6 and can there be opened during the intake stroke by means of longitudinal grooves 45 communicating with the annular groove 8. The distribution of these additional lines 44 can be seen in section in FIG. 4.

The second exemplary embodiment according to FIG. 5 is substantially similar in structure to that of FIG. 1. In a departure from that embodiment, however, the cylinder 17' is disposed inside the distributor 2' and contains the piston slide 18, which with its end faces encloses the first pressure chamber 21 and the second pressure chamber 34. As in the exemplary embodiment of FIG. 1, this distributor 2' also has an annular groove 8, which connects the pump work chambers with one another. The annular groove 8 communicates with the cylinder 17' via a radial through bore 46, which corresponds to the fuel supply line 15*a* of FIG. 1. The entry of the bore 46 into the cylinder 17' is controlled by the control edge 31 of the piston slide 18.

The supply of pressure medium to the first pressure chamber 21 is effected via a longitudinal bore 48 in the distributor 2' and a radial bore 49 leading away from it, which discharges into an external annular groove 50 on the distributor 2'. This annular groove 50 communicates constantly with the pressure line 23.

The second pressure chamber 34 communicates via a bore 51 with a second external annular groove 52 on the distributor 2', and the external annular groove 42 communicates continuously with the fuel supply line 15*b*. In this exemplary embodiment as well, additional supply lines 44 may be provided, which can be opened by longitudinal grooves 45.

The above-described apparatus functions in the same manner as the exemplary embodiment of FIG. 1, with the exception that in this latter case the valve having the piston slide 18 is disposed inside the distributor, and the control distances between the control edge 31 and the pump work chamber 9 can be kept still shorter. The described apparatus advantageously requires only a little space.

The exemplary embodiment shown in FIG. 6 entirely omits an additional piston slide by embodying the distributor itself as the piston slide. In a fuel injection pump of basically identical structure to that of the exemplary embodiment of FIG. 1, the embodiment of FIG. 6 is also provided with radially movable work pistons 3, which enclose the work chamber 9 within the pump housing 1. Here again, a distributor 2'' is provided for distributing the fuel injection quantity; it is driven to rotate and is disposed inside a cylinder 6 in a rotatable and displaceable manner. The distributor 2'' has the longitudinal distributor groove 11, which cooperates with the injection lines 12 disposed in the pump housing 1. The longitudinal groove permits an axial displacement on the part of the distributor 2'' without thereby influencing the control of the injection lines 12.

The distributor 2'' further has an annular groove 8, which communicates continuously with the work chambers 9.

Differing from the exemplary embodiment of FIG. 1, a coaxial bore 54 of reduced diameter adjoins one end of the cylinder 6, and a piston part 55 of the distributor 2'' is tightly guided within this bore 54 and protrudes out of the pump housing 1. The distributor is driven via this piston part 55, with a longitudinal slot 56 permitting an axial displacement of the distributor 2''. In the axial direction, the distributor 2'' is further stressed by a restoring spring 58, which tends to displace the distributor 2'' toward the drive side. In the cylinder 6, the remaining portion of the end face 59 between the full diameter of the distributor 2'' and the piston part 55 encloses a pressure chamber 60 which is in continuous communication with the pressure line 23. With the end edge 62 which defines it, the piston part 61 of the distributor 2'' formed between the end face 59 and the annular groove 8 controls communication between an internal annular groove 64 of the cylinder 8 and the annular groove 8 or the work chambers 9. The internal annular groove 64 is in continuous communication with the fuel supply line 15, from which a line 65 branches off and also leads into the cylinder 6. The mouth of the branch line 65 is opened in the event that the annular groove 64 is completely closed by the piston part 61 of the distributor 2'', in the right-hand terminal position of the distributor 2''. Communication between the pressure line 23 and the fuel supply line 15 is thus established via the pressure chamber 60, so that when the first valve 36 and the second valve 38 are both closed, the quantity of fuel delivered by the fuel supply pump 24 is capable of flowing back via the fuel supply line and the pressure in the pressure chamber 60 or on the supply side of the fuel supply pump will not increase excessively.

The apparatus just described functions in principle in the same manner as do the exemplary embodiments described earlier herein. During the intake phase of the pump piston 3, the first electrically actuatable valve 36 is opened. The pressure in the pressure chamber 60 thereby assumes the low supply pressure established by the pressure control valve 41', so that the distributor 2'' is displaced toward the left and opens the connection between the annular groove 64 and the work chamber 9. Fuel is now capable of flowing into the work chambers 9 until the rollers 5 on the cam ring 4 reach the low point of the cam. At the onset of injection, the first electrically actuatable valve 36 is again closed, so that a substantially higher pressure builds up in the pressure chamber 60 and the distributor is moved toward the right. From this instant, the fuel positively displaced by the piston 30 can no longer flow back to the fuel supply line 15; instead, it is supplied via the distributor groove 11 into one of the injection lines 12. In order to fix the end of injection, the second electrically actuatable valve 38 is then opened, so that the pressure at the distributor 2'' can again equalize, and the distributor 2'' is moved back toward the left under the influence of the spring. The remaining quantity of fuel supplied by the pump pistons 3 then escapes back to the fuel supply line, which is relieved via the pressure control valve 41'. In an advantageous manner, only one pressure control valve is necessary in this exemplary embodiment, and furthermore an additional piston slide 18' such as that in the exemplary embodiments of FIG. 1 or FIG. 5 is omitted.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. In a fuel injection pump having at least one pump work chamber enclosed by a pump piston in a pump cylinder, fuel distributing means for connecting the pump work chamber with at least one fuel injection location and fuel supply means for connecting the pump work chamber with a fuel supply in order to establish the fuel injection quantity wherein the fuel supply means includes a fuel supply line of the pump work chamber, a fuel supply pump for supplying fuel to the fuel supply line, a pressure control means for adjusting the supply pressure of the fuel supply pump, a valve disposed in the fuel supply line, and an electric control means for controlling the actuation of the valve, the improvement wherein:

the valve comprising a piston slide stressed by a restoring spring, a first end face of the piston slide defining a first pressure chamber which is continuously exposed to the supply pressure of the fuel supply pump and the piston slide having a control edge for controlling the passage of the fuel supply line to the pump work chamber;

the electric control means includes first and second electrically actuatable valves disposed in parallel lines for connecting the fuel supply line with the supply side of the fuel supply pump;

the pressure control means comprises a first pressure control valve for relieving pressure in the fuel supply line downstream of the two electrically actuatable valves;

wherein the fuel distributing means comprises a distributor rotating within a distributor cylinder connected with the at least one pump work chamber, the distributor having a circumferential surface defining a distributor groove and an annular groove for establishing communication between the distributor groove and the pump work chamber, wherein by means of which rotating distributor the pump work chamber is connected via the distributor groove one after another with individual injection lines leading to respective injection locations during the supply stroke of at least one pump piston;

the piston slide of the valve is disposed in a cylinder inside the distributor;

the piston slide with its control edge controls connecting bores between the annular groove on the distributor and the cylinder inside the distributor;

the cylinder inside the distributor downstream of the control edge communicates continuously with the fuel supply line; and the first pressure chamber enclosed by the first end face of the piston slide in the cylinder communicates continuously with the supply side of the fuel supply pump.

2. In a fuel injection pump having at least one pump work chamber enclosed by a pump piston in a pump cylinder, fuel distributing means for connecting the pump work chamber with at least one fuel injection location and fuel supply means for connecting the pump work chamber with a fuel supply in order to establish the fuel injection quantity wherein the fuel supply means includes a fuel supply line of the pump work chamber, a fuel supply pump for supplying fuel to the fuel supply line, a pressure control means for adjusting the supply pressure of the fuel supply pump, a valve disposed in the fuel supply line, and an electric control means for controlling the actuation of the valve, the improvement wherein:

the valve comprising a piston slide stressed by a restoring spring, a first end face of the piston slide defining a first pressure chamber which is continuously exposed to the supply pressure of the fuel supply pump and the piston slide having a control edge for controlling the passage of the fuel supply line to the pump work chamber;

the electric control means includes first and second electrically actuatable valves disposed in parallel lines for connecting the fuel supply line with the supply side of the fuel supply pump;

the pressure control means comprises a first pressure control valve for relieving pressure in the fuel supply line downstream of the two electrically actuatable valves;

wherein the fuel distributing means comprises a distributor rotating within a distributor cylinder connected with the at least one pump work chamber, the distributor having a circumferential surface defining a distributor groove and an annular groove for establishing communication between the distributor groove and the pump work chamber, wherein by means of which rotating distributor the pump work chamber is connected via the distributor groove one after another with individual injection lines leading to respective injection locations during the supply stroke of at least one pump piston; and wherein the distributor is axially displaceable and, itself embodied as piston slide and stressed by a restoring spring, communicates continuously at one end face with the supply side and is in parallel with the first electrically actuatable valve and the second electrically actuatable valve.

3. A fuel injection pump as defined by claim 2, wherein:

the distributor has a piston part, which encloses the first pressure chamber in the cylinder;

the first pressure chamber communicates continuously with the supply side of the fuel supply pump upstream of the first and the second electrically actuatable valves; and the piston part has a control edge, which defines an external annular groove on the distributor and which controls an entry opening of the fuel supply line into the annular chamber enclosed by the annular groove in the cylinder, which annular chamber communicates continuously with the pump work chamber.

4. A fuel injection pump as defined by claim 1, wherein the fuel supply line further comprises a branch line bypassing the valve and controlled by a control edge on the distributor to be connected with the pump work chamber.

5. A fuel injection pump as defined by claim 3, which further comprises a pressure relief line which is opened by means of the piston part of the piston slide disposed in a terminal position in which it has been displaced counter to the restoring spring.

6. A fuel injection pump as defined by claim 2, wherein the fuel supply line further comprises a branch line bypassing the valve and controlled by a control edge on the distributor to be connected with the pump work chamber.

* * * * *